US005707126A

United States Patent [19]

Neufeld et al.

[11] Patent Number: 5,707,126

[45] Date of Patent: Jan. 13, 1998

[54] SELF-RETRACTING, WALL-MOUNTED DESK AND CHART HOLDER

[75] Inventors: Vida Jo Neufeld, Dallas, Tex.; Bill J. Hawks, Jr., Wichita, Kans.

[73] Assignee: Via Christi Research Inc., Wichita, Kans.

[21] Appl. No.: 598,111

[22] Filed: Feb. 7, 1996

[51] Int. Cl.[6] ..... A47B 67/02; A47F 5/08

[52] U.S. Cl. ..... 312/245; 312/242; 312/315; 312/317.3; 108/37

[58] Field of Search ..... 312/245, 242, 312/317.3, 315, 302, 319.2, 319.4; 211/88, 90, 87; 108/37, 136

[56] References Cited

U.S. PATENT DOCUMENTS

| | | | |
|---|---|---|---|
| 194,971 | 9/1877 | Morgan | 312/245 |
| 837,000 | 11/1906 | Sibley | 312/245 |
| 925,397 | 6/1909 | Snyder | 312/315 |
| 1,410,713 | 3/1922 | Norquist | 312/315 X |
| 1,655,516 | 1/1928 | Simpson | 312/242 X |
| 1,758,238 | 5/1930 | Peterson | 312/245 X |
| 1,954,632 | 4/1934 | Lehman | 312/315 X |
| 2,340,762 | 2/1944 | Lundin | 312/315 |
| 3,606,509 | 9/1971 | Bennett | 312/242 |
| 3,988,909 | 11/1976 | Catapano | 312/245 X |
| 4,155,609 | 5/1979 | Skaffe et al. | 312/245 |
| 4,263,854 | 4/1981 | Moore et al. | 108/37 |
| 4,382,641 | 5/1983 | Abel | 312/302 X |
| 4,919,498 | 4/1990 | Turner | 312/245 X |
| 5,020,867 | 6/1991 | McManus | 312/317.3 X |
| 5,427,231 | 6/1995 | Williamann | 211/87 X |
| 5,460,101 | 10/1995 | Garbutt, Sr. | 312/245 X |
| 5,513,574 | 5/1996 | Collins | 312/242 X |
| 5,544,958 | 8/1996 | McAffee | 312/245 X |

FOREIGN PATENT DOCUMENTS

| | | | |
|---|---|---|---|
| 178310 | 4/1922 | United Kingdom | 312/317.3 |

OTHER PUBLICATIONS

Wend–Wood, Inc.—Catalog, Front coversheet and p. 14–1, publication date circa 1992.

RG & A Products—Retractable Workstation Brochure, two pages, publication date unknown.

Carstens Health Industries, Inc.—1994 General Catalog (#CHI–94), front and back coversheets and page showing the Wallaroo and Wallaroo Jr. Work Stations.

Eastern Rail Systems—Healthcare Components—Mailer A19 showing Fred—The Wall Desk/Chartrack, Part #025192, publication date unknown.

*Primary Examiner*—Peter M. Cuomo
*Assistant Examiner*—Rodney B. White
*Attorney, Agent, or Firm*—Hovey,Williams, Timmons & Collins

[57] ABSTRACT

A self-retracting, wall-mounted desk and chart holder especially useful as a decentralized nurses' station is provided having a slim profile, compact construction, and being specifically designed for mounting on walls outside patient rooms. The chart holder includes a body having structure for defining a side entry storage slot of sufficient width to receive a medical chart standing on edge and extending parallel to the wall on which the chart holder is mounted. The slot is shorter than the chart so that a portion of the chart may project out beyond the slot and above the slot to make it visible at-a-glance. The chart holder further includes a desktop which is swingably attached to the body for movement of the desktop between a horizontal open position for use as a work surface, and a vertical closed position.

9 Claims, 3 Drawing Sheets

SMITH, J.

SELF-RETRACTING, WALL-MOUNTED DESK AND CHART HOLDER

BACKGROUND OF THE INVENTION

1. Field of the Invention

This invention relates to a combination self-retracting, wall-mounted desktop and chart holder having a slim profile and being adapted for mounting in a hospital or nursing home hallway outside a patient's room to provide a decentralized nurses' station. More particularly, it is concerned with a chart holder having at least one open sided slot oriented and configured to receive and retain a medical chart standing on one edge so that at least a portion of the chart is visible to display, at-a-glance, information about a particular patient.

2. Description of the Prior Art

In hospitals, patient charts are generated for each patient by doctors, nurses, and other hospital staff for record keeping purposes. Once generated, and when not in use, all patient charts for the floor or section of the hospital are typically stored and maintained at a single centralized nurses' station. A centralized nurses' station may serve any number of patient rooms located at varying distances from the station. If a doctor or nurse wishes to use or consult a patient's chart while visiting the patient, a trip must first be made to the centralized nurses' station to obtain the chart. Further, when the doctor or nurse completes their use of the chart, it must be returned to storage by making another trip to the centralized nurses' station.

As can be appreciated, the obvious expedient of providing a conventional centralized nurses' station for chart and medication storage, use and management, will inevitably lead to a waste of valuable time associated with unnecessary trips by staff back and forth between the centralized nurses' station and patient rooms. Having all charts at one place also consumes a considerable amount of valuable floor space.

Decentralized chart racks having retractable desktops have been proposed in the past for mounting on walls outside patient rooms. In general, however, these units have not been acceptable because they are bulky and may unacceptably encumber the flow of traffic in hallways.

SUMMARY OF THE INVENTION

The problems outlined above are in large measure solved by the self-retracting wall-mounted desk and chart holder in accordance with the present invention. That is to say, the chart holder hereof is of slim profile, compact construction, and is specifically designed for mounting on walls outside patient rooms to provide a decentralized nurses' station.

The slim profile chart holder in accordance with the present invention broadly includes a body having structure for defining a side entry storage slot of sufficient width to receive a medical chart only when it is standing on edge and extending generally parallel to the wall on which the holder is mounted. The slot is sized so that portions of the chart may project above and out beyond the slot to make it visible at-a-glance.

In particularly preferred forms, the structure that defines the slot includes a chart retaining shelf having a rear edge that lies up against the hallway wall when the holder is mounted in place, and a retaining wall extending upwardly from said shelf and set back from said edge. The chart wall and shelf cooperate with the hallway wall to define the slot when the holder is in place.

When a medical chart is standing on edge in the slot, a portion of the chart hangs out beyond the slot and another portion extends above the slot for clear display of any tagged or flagged medical or doctor's orders, and to facilitate communication of information at-a-glance. The chart holder of the present invention also provides the hospital staff with the tools and office supplies they need outside the patient's room during any particular shift, to fulfill their required tasks without the need of making unnecessary trips to a centralized nurses' station.

The chart holder of the invention further includes a desktop which is swingably attached to the body for movement of the desktop between a horizontal open position for use as a work surface, and a vertical closed position. The desktop and body have a geometric relationship such that when the desktop is in the vertical closed position, the chart holder has a slim profile so as not to present any appreciable obstruction to traffic passing by.

These and other objects of the invention will be appreciated from an examination of the following description and drawings.

DESCRIPTION OF THE PREFERRED EMBODIMENT

Figures 1, 2, 5, 6, 7:
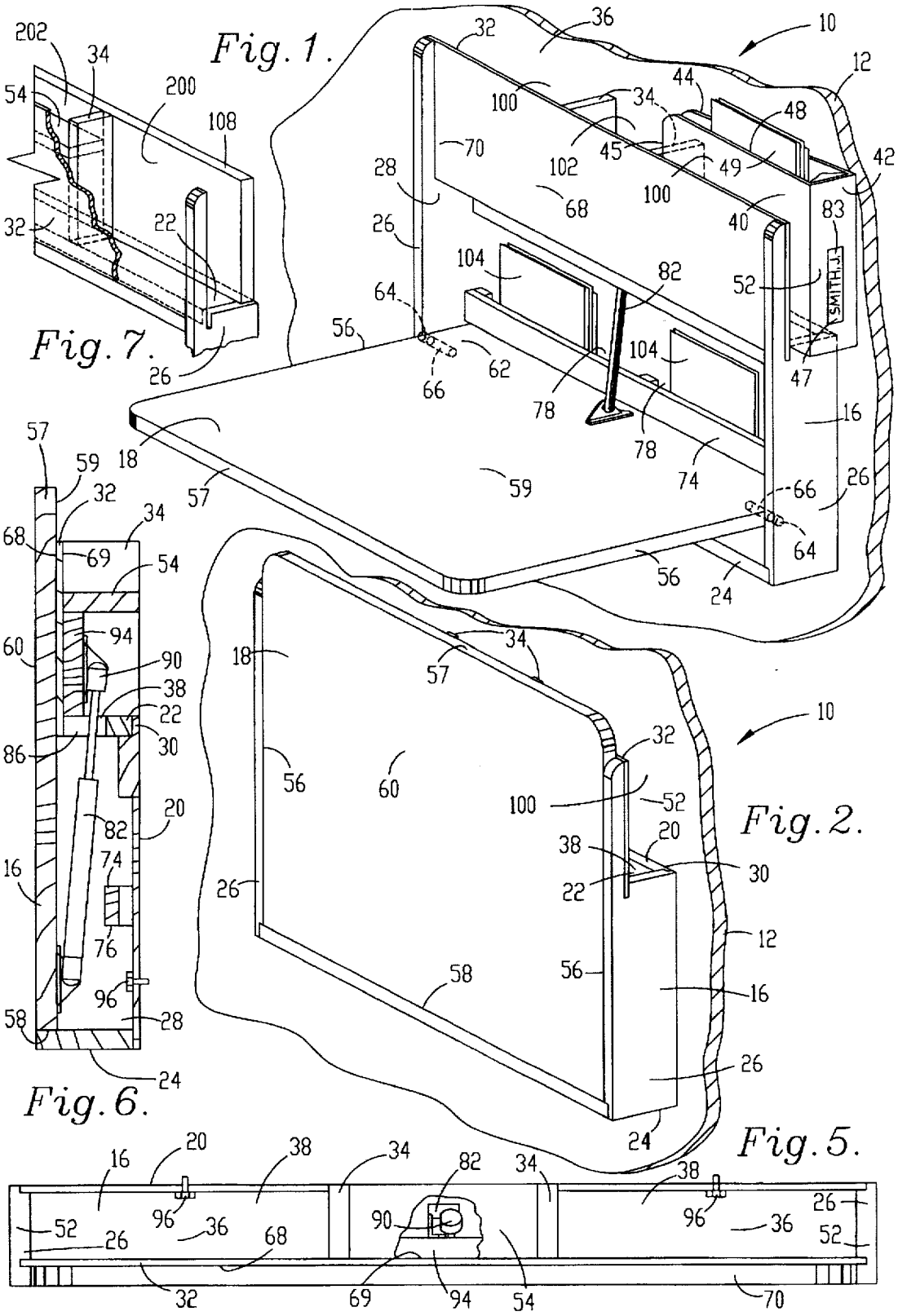
FIG. 1 is a perspective view of a chart holder in accordance with the invention, shown in an upright orientation and mounted to a hallway wall or other upright surface with the desktop shown extending in the horizontally open position.
FIG. 2 is a similar view of the chart holder showing the desktop in the vertically closed position.
FIG. 5 is a top plan view of the chart holder with a portion broken away to reveal the desktop fold-up cylinder.
FIG. 6 is a vertical sectional view taken substantially along the line 6—6 of FIG. 3 and illustrating the internal construction of the chart holder.
FIG. 7 is a fragmentary isometric view of an alternative embodiment showing a chart retaining slot which includes first and second chart retaining walls.

Referring now to the drawings, there is illustrated a decentralized nurses' station in the form of a combination desktop and chart holder 10 adapted for mounting to upright surface 12, that embodies the features of the invention.

The combination desk and chart holder 10 broadly includes a cabinet body 16 and a retractable desktop 18. The cabinet body 16 and desktop 18 may be formed of wood, metal or molded plastic components. Cabinet body 16 includes a vertically disposed rear wall 20, a top wall 22, a bottom wall 24 and side portions or upright side walls 26, all extending forwardly from rear wall 20 to form therewith a hollow compartment 28 that is open at the front. An upper rear edge 30 is presented at the intersection of top wall 22 and rear wall 20.

A vertical chart retaining wall 32 extends upwardly from top wall 22, is spaced forwardly of the upper rear edge 30, is generally parallel to rear wall 20 and extends between side walls 26. A pair of upright, relatively closely spaced, centrally disposed, transverse abutment walls 34 extend rearwardly from the retaining wall 32 and are in general parallel relationship to one another. Abutment walls 34 cooperate with the retaining wall 32 and top wall 22 to form a pair of oppositely facing nooks 36. Nooks 36 are mirror images of one another, but in all other respects are identical. Nooks 36 are configured to receive and retain patient medical charts, which will now be generally described.

A medical chart 40, of the type which the chart holder 10 is configured to receive and retain, is of conventional design and typically comprises a ring binder including a spine 42, and top and bottom protective covers, 43 and 44. The covers are attached at one end to spine 42, and have their opposite ends 45 and 46 free to move toward and away from one another. Top cover 43 is shown in FIG. 1 with a name tag 47 affixed thereto. Chart 40 is configured to confine and store medical records and documents created and used by doctors, nurses and other hospital staff in connection with the administration of health care to a particular patient. Such records and documents include physicians' orders, medication records, lab reports, and the like. Such medical records and documents, usually an 8½×11 inch format, are bound in the chart by conventional means such as binder rings associated with spine 42. The length and width of the chart top and bottom covers 43, 44, are typically slightly greater than that of the records the chart 40 is intended to contain. The width of the chart spine 42 may vary, but typically has a dimension of two inches. Top cover 43 and bottom cover 44, when closed on one another, cooperate to define opposite chart side edges 48.

One important purpose of chart 40 is to serve as a means to communicate information, including, physicians orders, between a doctor who prescribes medical care and nursing staff who implement the prescribed care. To enhance such communication between doctors and nurses, doctors often employ either a tagging or flagging techniques. Tags 47 may be affixed to the portion of chart 40, such as spine 42, hanging out end opening 52, as shown in FIG. 1. The flagging technique is used to bring recently prepared orders to nurses' attention. That technique simply involves the diagonal folding of a document bound in a chart to cause the non-bound end of the document to extend outwardly from either chart side edge 48, as illustrated in FIG. 1 with respect to "flag" 49. The length of each nook 36 is less than the length of chart side edges 48 so that a portion of the chart 40 hangs out beyond the nook 36.

Returning now to the description of cabinet body 16, each nook 36 presents a shelf 38 of sufficient width to receive the medical chart 40 standing on side edge 48, as shown in FIG. 1. Each nook 36 further includes an end opening 52 extending generally parallel to upright surface 12. An office supply storage shelf 54 (FIGS. 3 and 6) extends between the abutment walls 34 and is spaced upwardly from and generally parallel to the top wall 22.

Figure 3:
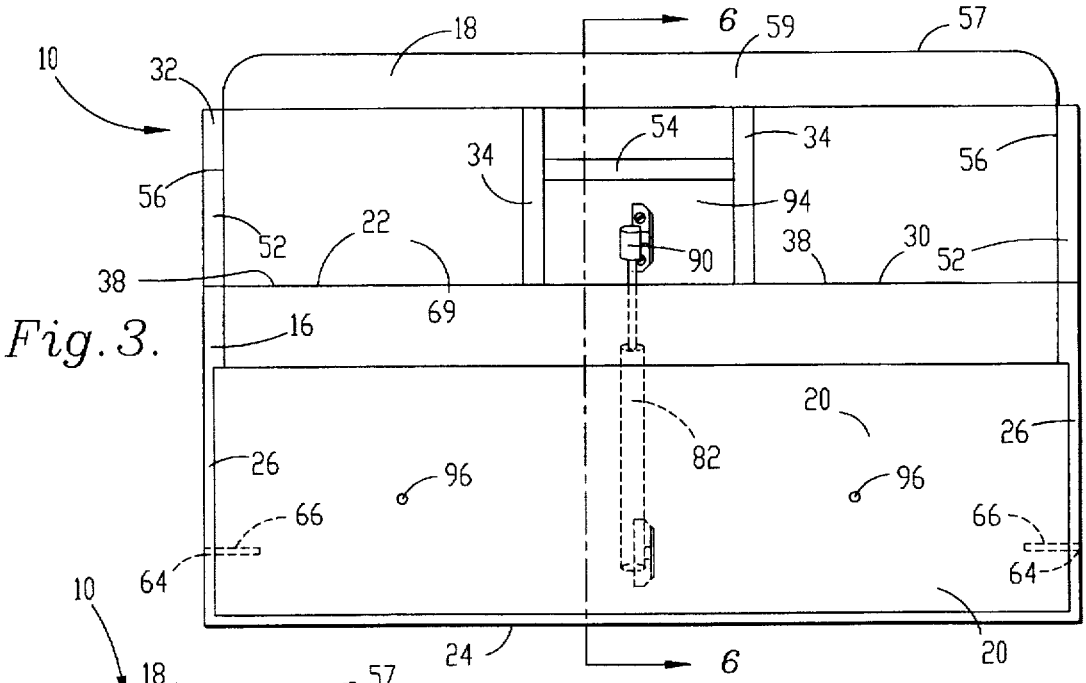
FIG. 3 is a rear elevational view of the devices.
Figure 4:
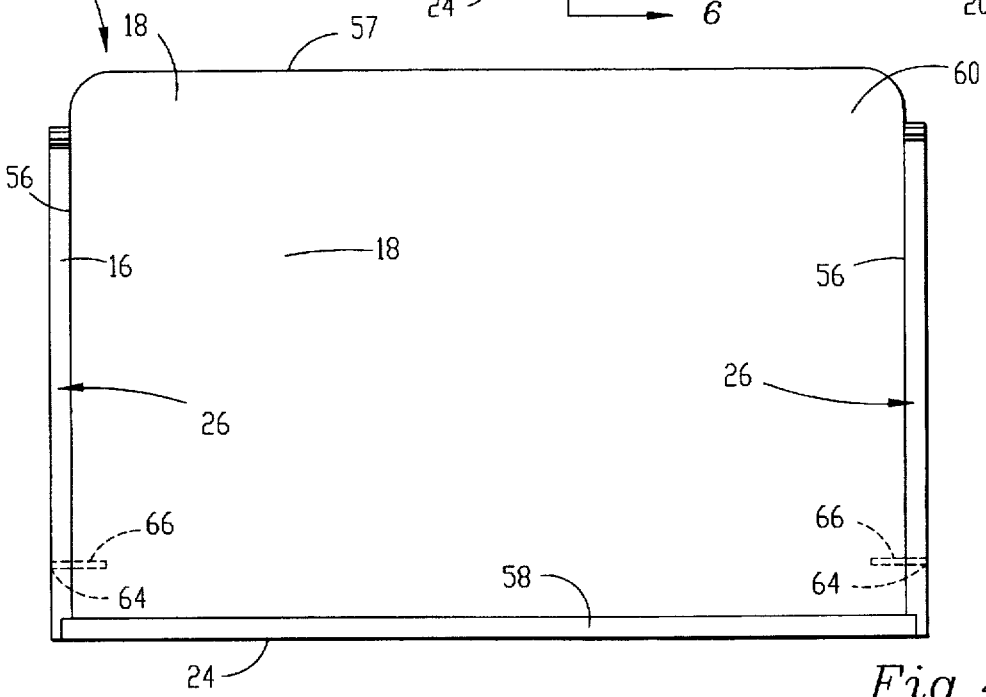
FIG. 4 is a frontal elevational view of the chart holder with the desktop shown in the vertical closed position.
Figure 8:
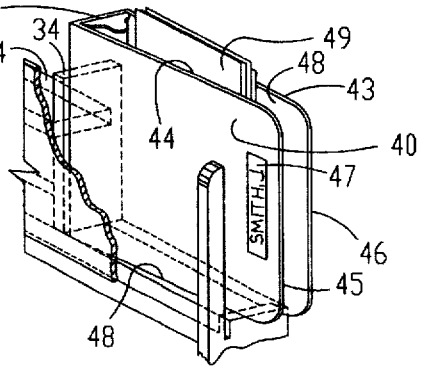
FIG. 8 is a side elevational view of a medical chart shown standing on a side edge.

The cabinet body 16 is provided with desktop 18 which presents desktop side edges 56 a desktop front edge 57, a desktop rear edge 58, upper surface 59 and lower surface 60. Desktop 18 is swingably attached by hinge means 62 to cabinet body 16 so that desktop 18 is movable with respect to the cabinet body 16 by the application of external force between an open horizontal position (FIG. 1), an intermediate position, and a vertical closed position (FIG. 2). In the preferred embodiment, hinge means 62 includes openings 64 in the two side walls 26 that pivotally receive pivot pins 66 extending outwardly from desktop side edges 56 in the proximity of desktop rear edge 56, as shown in FIGS. 1 and 3. Openings 64 and projections 66 are positioned so that when desktop 18 is in the vertical closed position, it completely conceals hollow compartment 28, as shown in FIG. 2.

Retaining wall 32 presents a forward facing surface 68 which defines a depression 70 for receiving the upper portion of desktop 18 when it is in the vertical closed position, as shown in FIG. 2. In the vertical closed position, desktop 18 cooperates with depression 70 so that the cabinet body 16 presents a slim profile.

A rail 74 is horizontally disposed in hollow compartment 28 and extends between and is secured to side walls 26. Rail 74 presents a lower flange surface 76 (FIG. 6) extending between side walls 26 for abutting engagement with desktop rear edge 58 when the desktop is down. Thus, flange surface 76 cooperates with rear desktop edge 58 to maintain desktop 18 in the horizontal open position for use as a working surface, when desired. Rail 74 is also provided with recesses or pockets 78 which cooperate with rear wall 20 to provide spaces for receipt and storage of documents or other materials 104 within hollow compartment 28.

Referring now to FIGS. 1 and 6, a spring means is provided in the form of telescoping cylinder 82 (gas or spring operated) which is pivotally attached at one end to the desktop upper surface 59 in the proximity of rear desktop edge 58. As shown in FIG. 6, the rod end of cylinder 82 extends through an opening 86 in top wall 22 and is attached by means of a swivel fastener 90 to a reinforcing member 94 which is secured to the rearward surface 69 of retaining wall 32 between the abutment walls 34 and below the office supply storage shelf 54. The geometric relationship between the cylinder 82 and the pivot pins 66 is such that upon removal of the external force, the desktop 18 will move down to the horizontal open position if the desktop is positioned between the intermediate position and the horizontal open position. Conversely, the desktop 18 will move up to the vertical closed position if the desktop 18 is positioned between the intermediate position and the vertical closed position. Cylinder 82 may, in the alternative, be adjustable so that if all external force is removed from the desktop when in its horizontal open position, the desktop will self-retract into its upright vertical closed position.

A fastener means, in the form of screws 96, secures the cabinet body 16 to upright surface 12 with the open end 52 of each nook 36 facing generally horizontally. Once the cabinet body 16 is secured to the upright surface 12, the chart retaining wall 32, chart shelf 42 and abutment walls 34 cooperate with the upright surface to define mutually opposed chart slots 100. It is to be understood, however, that chart holder 10 need only be provided with a single slot 100. Each slot 100 is configured to receive and retain a chart 40 standing on edge, such as chart side edge 48, and the length of slots 100 is such that chart cover ends 45, 46, extend outwardly through open end 52, as shown in FIG. 1, to display tagged information to enhance communication of information at-a-glance. Further, office supply storage shelf 54 and abutment walls 34 and a centrally disposed portion of rear wall 20 cooperate with the upright surface 12 to define a office supply storage slot 102.

The use of chart holder 10 will now be described. In use, chart holder 10 is mounted on the wall outside a patient's room, nursing home room, or the like for the purpose of providing a decentralized nurses' station for storage and use of medical charts 40, medication and the like. From this location, a doctor or nurse intending to visit or check on a patient may conveniently obtain the patient's chart without the need to make the trip to a centralized nurses' station where charts are otherwise stored. Further, following the patient visit, the chart may simply be returned to the slot 100 and the chart holder 10, again limiting the need to make an additional trip to the centralized nurses' station. In the case when a physician has generated and flagged physician's orders as described above, the physician needs simply to place the chart on side edge 48 in slot 100 to visually bring the orders to the attention of attending nurses who pass by the patient's room. Chart holder 10 may also be used to make various types of patient information, such as a patient's name, visible at-a-glance, by printing the information (such as indicia 83 as shown on tag 47 in FIG. 1) on the chart cover extending through an opening 52.

Another unique feature of the invention is that because of its slim profile when desktop 18 is in the vertical closed position, the chart holder 10 does not present any appreciable obstruction to traffic passing by. In fact, the chart holder 10 is sufficiently slim in profile that the distance it extends outwardly from the vertical surface or walls upon which it is mounted does not exceed that of conventional hand rails which may be installed (which are usually required by fire code not to exceed about 4½ inches).

In an alternative embodiment, cabinet body 16 includes a second chart retaining wall 108 which is parallel to and extends upwardly from rear wall 20. Retaining wall 108 cooperates with chart retaining wall 32, chart shelf 38, and abutment walls 34 to define chart slots 200 and medicine storage slot 202.

Figure 9:
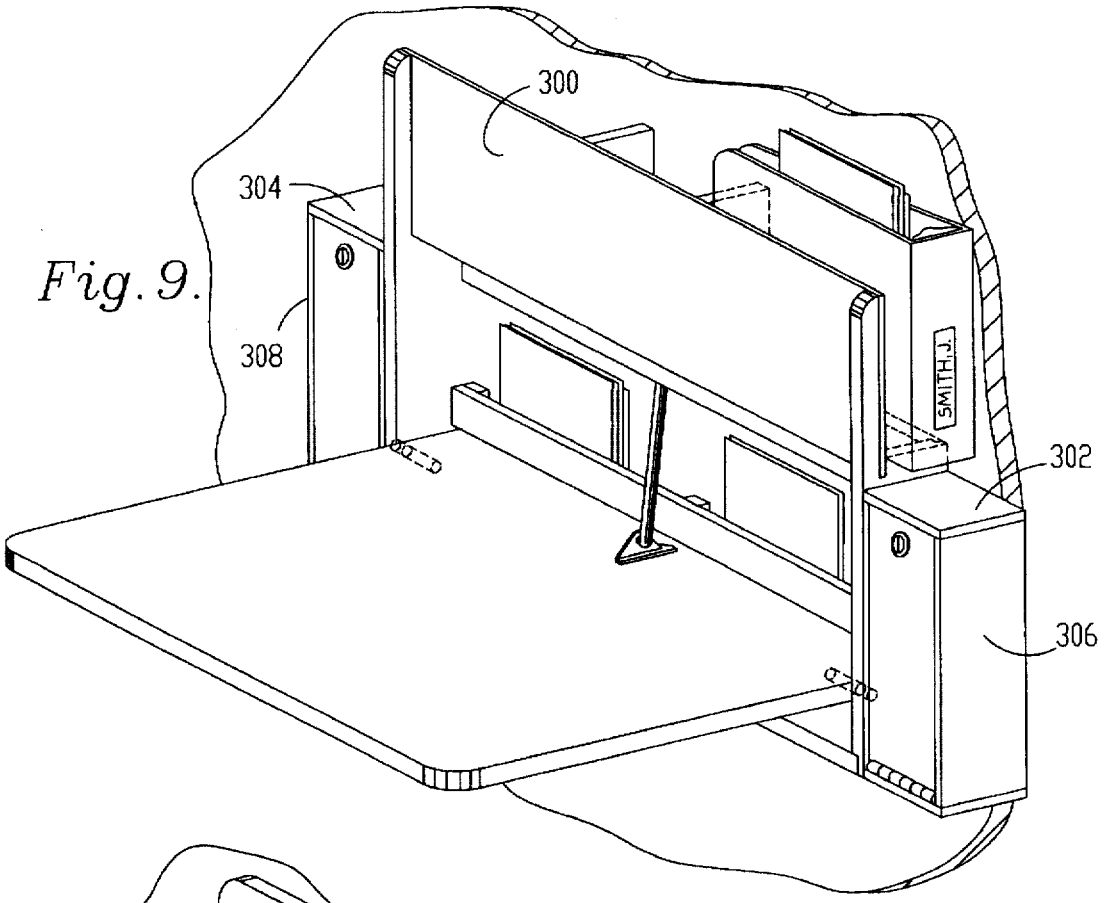
FIG. 9 is a perspective view of an alternative chart holder having lockable medicine cabinets attached to the chart holder side walls, shown with the desktop extended in the horizontally open position.
Figure 10:
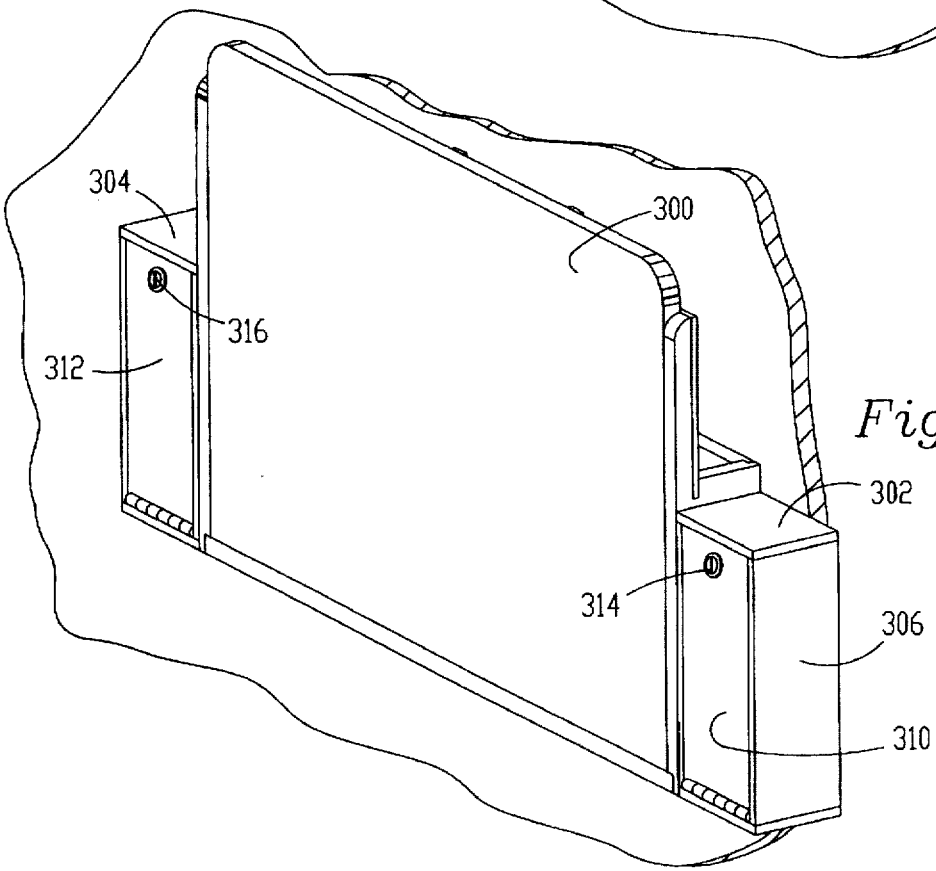
FIG. 10 is a similar view of an alternative chart holder with the desktop in the vertically closed position.

In yet another alternative embodiment shown in FIGS. 9 and 10, chart holder 300 is shown with a pair of lockable medicine cabinets 302,304 attached to and extending outwardly from sidewalls 26. Medicine cabinets 302,304 include hollow enclosures 306,308, respectively, and doors 310,312 hingeably secured thereto, as shown in FIGS. 9 and 10. Each door 310,312 is provided with locks 314,316, to prevent unauthorized access into medicine cabinets 302,304. In all other respects, chart holder 300 is identical to chart holder 10, as described above.

Thus, it should be understood that the invention provides a relatively inexpensive slim profile and extremely efficient decentralized nurses' station adapted for mounting on a wall in the proximity of a patient's room to provide for the readily accessible storage of charts, medication, and other printed material.

We claim:

1. A slim profile chart holder adapted for attachment to an upright surface comprising:

a body having structure for defining a storage slot of sufficient width to receive a medical chart standing on edge and extending generally parallel to said upright surface, said body having a side portion provided with an end opening of said slot and through which a portion of the chart may project when the chart is received in the slot;

fastener means for securing said body to the upright surface with said end opening of the slot facing generally horizontally to expose yet retain the chart in the slot;

a desktop;

hinge means swingably attaching said desktop to said body so that said desktop is moveable with respect of said body, by application of external force, along a range of movement defined between a horizontal open position and a vertical closed position; and spring means associated with said body for exerting an upward force on said desktop throughout the range of movement therefor, said spring means configured to support said desktop so that upon removal of said external force said desktop will move to the horizontal open position if said desktop is positioned between an intermediate position and the horizontal position, and said desktop will move to the vertical closed position if said desktop is positioned between said intermediate position and said vertical closed position.

2. A slim profile combination desk and chart holder adapted for attachment to an upright surface comprising:

a cabinet body including a vertical rear wall, top, bottom, and side walls extending forwardly therefrom and forming with said rear wall a hollow compartment, said vertical rear wall and said side walls having edges that are substantially flush with said top wall, a vertical chart retaining wall extending upwardly from said top wall and spaced forward of and being generally parallel to said rear wall, a transverse abutment wall extending rearwardly from said chart retaining wall and cooperating with said chart retaining wall and said top wall to form a nook; and a fastener means for securing said vertical rear wall of said cabinet body to an upright surface with said top wall disposed upwardly so that said nook forms with the upright surface, when the body is secured to the surface, a slot having a configuration to receive and confine a medical chart placed therein.

3. A combination desk and chart holder as set forth in claim 2; and a desktop; and a hinge means swingably attaching said desktop to said body for movement of said desktop with respect to said body by application of an external force between a horizontal open position, an intermediate position and a closed vertical position.

4. A slim profile combination desk and chart holder adapted for attachment to an upright surface comprising:

a cabinet body including a vertical rear wall, top, bottom and side walls extending forwardly therefrom and forming with said rear wall a hollow compartment a vertical chart retaining wall extending upwardly from said top wall and spaced forward of and being generally parallel to said rear wall, a transverse abutment wall extending rearwardly from said chart retaining wall and cooperating with said chart retaining wall and said to wall to form a nook;

fastener means for securing said body to an upright surface with said to wall disposed upwardly so that said nook cooperates with the upright surface to present a slot having a configuration to receive and confine a medical chart placed therein;

a desktop;

a hinge means swingably attaching said desktop to said body for movement of said desktop with respect to said body, by application of an external force along a range of movement defined between a horizontal open position and a closed vertical position; and a spring means for exerting an upward force on said top throughout the range of movement therefor, said spring means configured to support said desktop so that upon removal of said external force the desktop will move to the horizontal open position if said desktop is positioned between an intermediate position and the horizontal position, and said desktop will move to the vertical closed position if said desktop is positioned between said intermediate position and said vertical closed position.

5. A slim profile chart holder adapted for attachment to an upright surface comprising;

a body having a pair of opposite sides, a top surface, a front, and a back and structure for defining a pair of slots extending inwardly from respective sides of the body such that the slots have open ends at the respective sides, said structure comprising an upright abutment wall disclosed on said top surface extending from the front to the back, each of said slots being configured to receive a medical chart in an upright position, with at least a portion of the chart projecting through the open end of the slot.

6. A slim profile combination desk and chart holder adapted for attachment to an upright surface comprising;

a cabinet body having top, bottom, and sidewalls forming a hollow compartment with an open front, a desktop swingably mounted on said body and moveable with respect to said body by application of external force between a horizontal open position and a vertical closed position, in which said desktop is in covering relationship with the open front of the compartment, said desktop swinging in a generally upward direction as it moves toward said vertical closed position and swinging in a generally downward direction as it moves toward said horizontal position; and means associated with said cabinet body for holding a medical chart, said chart holding means comprising an opened-end slot on a sidewall of the cabinet body above the hollow compartment.

7. A combination desk and chart holder as set forth in claim 6; and said means for holding the medical chart being in the form of structure defining a horizontal slot.

8. A combination desk and chart holder as forth in claim 7; and said slot being shorter than the medical chart so that the medical chart hangs out form the slot when the medical chart is placed in the slot on edge.

9. A combination desk and chart holder as set forth in claim 7; and said slot configured so that when the medical chart is placed in the chart standing on edge, a portion of the chart projects upwardly from said slot.

* * * * *